US006082727A

United States Patent [19]

Thompson

[11] Patent Number: 6,082,727

[45] Date of Patent: Jul. 4, 2000

[54] TOP VACUUM CORRUGATION FEEDER WITH ACTIVE RETARD SEPARATION MECHANISM

[75] Inventor: Bruce A. Thompson, Fairport, N.Y.

[73] Assignee: Xerox Corporation, Stamford, Conn.

[21] Appl. No.: 08/792,911

[22] Filed: Jan. 21, 1997

[51] Int. Cl.[7] ..... B65H 3/12

[52] U.S. Cl. ..... 271/94; 271/104; 271/106

[58] Field of Search ..... 271/4, 44, 104, 271/106, 30.1, 122, 34, 10.08

[56] References Cited

U.S. PATENT DOCUMENTS

| | | | |
|---|---|---|---|
| 3,173,684 | 3/1965 | Bonzoni et al. | 271/122 |
| 3,198,514 | 8/1965 | Barbera et al. | 271/94 |
| 4,887,805 | 12/1989 | Herbert et al. | 271/94 |
| 5,052,675 | 10/1991 | Shehata et al. | 271/94 |

FOREIGN PATENT DOCUMENTS

| | | | |
|---|---|---|---|
| 0044433 | 3/1980 | Japan | 271/94 |
| 405097263 | 4/1993 | Japan | 271/122 |
| 435324 | 10/1967 | Switzerland | 271/94 |

*Primary Examiner*—H. Grant Skaggs

[57] ABSTRACT

A cut sheet feeder includes the combination of a top vacuum corrugation feeder mechanism followed by a top active retard feeder roll separation mechanism is noise efficient, highly reliable and provides for great latitude in feeding variations of paper.

4 Claims, 3 Drawing Sheets

TOP VACUUM CORRUGATION FEEDER WITH ACTIVE RETARD SEPARATION MECHANISM

BACKGROUND OF THE INVENTION

This invention relates generally to an electrographic printing machine, and more particularly, concerns an improved copy sheet feeder for such a machine.

High speed xerographic reproduction machines and printers, such as, the Xerox DocuTech® 135 and Xerox® 5090 produce copies at a rate in excess of several thousand copies per hour, and therefore, the need for reliable high speed feeding of copy sheets is essential. Presently, some copiers and printers use top vacuum corrugation feeders with a front air knife. In this system, a vacuum plenum with a plurality of friction belts are arranged to run over the vacuum plenum is placed at the top of a stack of sheets in a supply tray. The vacuum system is sized such that there is high open port flow to be able to acquire sheets, but a lower closed port pressure as to not damage or smear the sheets. At the front of the stack, an air knife is used to inject air into the stack to raise the top several sheets from the remainder of the stack. The air pressure actually required to physically separate sheets 1 and 2 from the stack can vary greatly dependent on the basis weight, static conditions, curl conditions, and edge welding properties of the paper. The air knife, however, is designed based on a single air pressure setting for the air knife assembly. This air pressure must be adequate for basis weights from 56 gsm to 200 gsm. This is usually a mutually exclusive event. Therefore, a basic latitude issue arises as to the air pressure requirements for heavy versus lightweight paper. In operation, air is injected by the air knife toward the stack to separate the top sheet, the vacuum pulls the separated sheet up and acquires it. Following acquisition, the belt transport drives the sheet forward off the stack of sheets. In this configuration, separation of the next sheet cannot take place until the top sheet has cleared the stack. In this type of feeding system every operation takes place in succession or serially, and therefore, the feeding of subsequent sheets cannot be started until the feeding of the previous sheet has been completed. In addition, in this type of system, the air knife may cause the second sheet to vibrate independent of the rest of the stack in a manner referred to as "flutter". When the second sheet is in this situation, if it touches the top sheet, it may tend to creep forward slightly with the top sheet. The air knife then may force the second sheet against the first sheet causing a shingle or double feeding of sheets.

Also, some current top and bottom vacuum corrugation feeders utilize a valved vacuum feedhead, e.g., U.S. Pat. No. 4,269,406 which is included herein by reference. At the appropriate time during the feed cycle, the valve is actuated establishing a flow and hence a negative pressure field over the stack top or bottom if a bottom vacuum corrugation feeder is employed. This field causes the movement of the top sheet(s) to the vacuum feedhead where the sheet is then transported to the takeaway rolls. Once the sheet feed edge is under control of the takeaway rolls, the vacuum is shut off. The trail edge of this sheet exiting the feedhead area is the criteria for again activation the vacuum valve for the next feeding. While these feeders are successful to some extent in feeding copy sheets at high rates of speed, there is still a need for a more reliable high speed feeder that is lower in cost, lower in noise level lower in power requirements, and with increased feeder latitude and reduced shutdown rate than has been practiced heretofore.

PRIOR ART

For example, a top vacuum corrugation feeder is shown in U.S. Pat. No. 4,887,805 that employs a belt coast control member that controls the precise stopping position of vacuum belts that surround a vacuum feedhead in order to minimize multifeeding of sheets from a stack. A slip clutch applies a torque to a drag roll in the multifeed detection system in U.S. Pat. No. 4,203,586 in order to detect double feeds from a sheet stack A multifeed detection system for a recirculating document handler that could include a vacuum corrugation feeder is disclosed in the Xerox Disclosure Journal Vol. 20, No. 5, September/October 1995, pages 414 and 417 that provides a detection system in which sheets are separated downstream of the feeder to enable detection as an overlength sheet by a pre-existing arrangement of sensors and jam detection logic. The failure to detect a multiple document sheet feed can result in loss of job integrity in that many sets would be printed with a missing page. U.S. Pat. No. 5,088,713 shows a bottom sheet refeeding document handler that employs a vacuum chamber with an air knife and retard mechanism to separate the bottommost sheet in a stack from the remainder to the stack.

SUMMARY OF THE INVENTION

Accordingly, in answer to the above-mentioned high speed sheet feeder deficiencies, a top sheet feeding apparatus is disclosed that includes a sheet support tray adapted to support a stack of copy sheets and a feedhead that includes a vacuum chamber adapted to extend over the front of the stack of sheet when sheets are placed in the support tray. The vacuum plenum has a plurality of perforated belts mounted on drive and idler rolls and entrained therearound for individually transporting copy sheets attached thereto by vacuum pressure from the vacuum plenum in a predetermined direction. A top active retard roll separation mechanism positioned beneath a downstream end of the plurality of perforated belts and adapted to separate double feeds transported thereinto by the feedhead.

BRIEF DESCRIPTION OF THE DRAWINGS

For a better understanding of the invention, as well as other objects and further features thereof, reference is made to the following drawings.

DETAILED DESCRIPTION OF THE INVENTION

Figure 3:
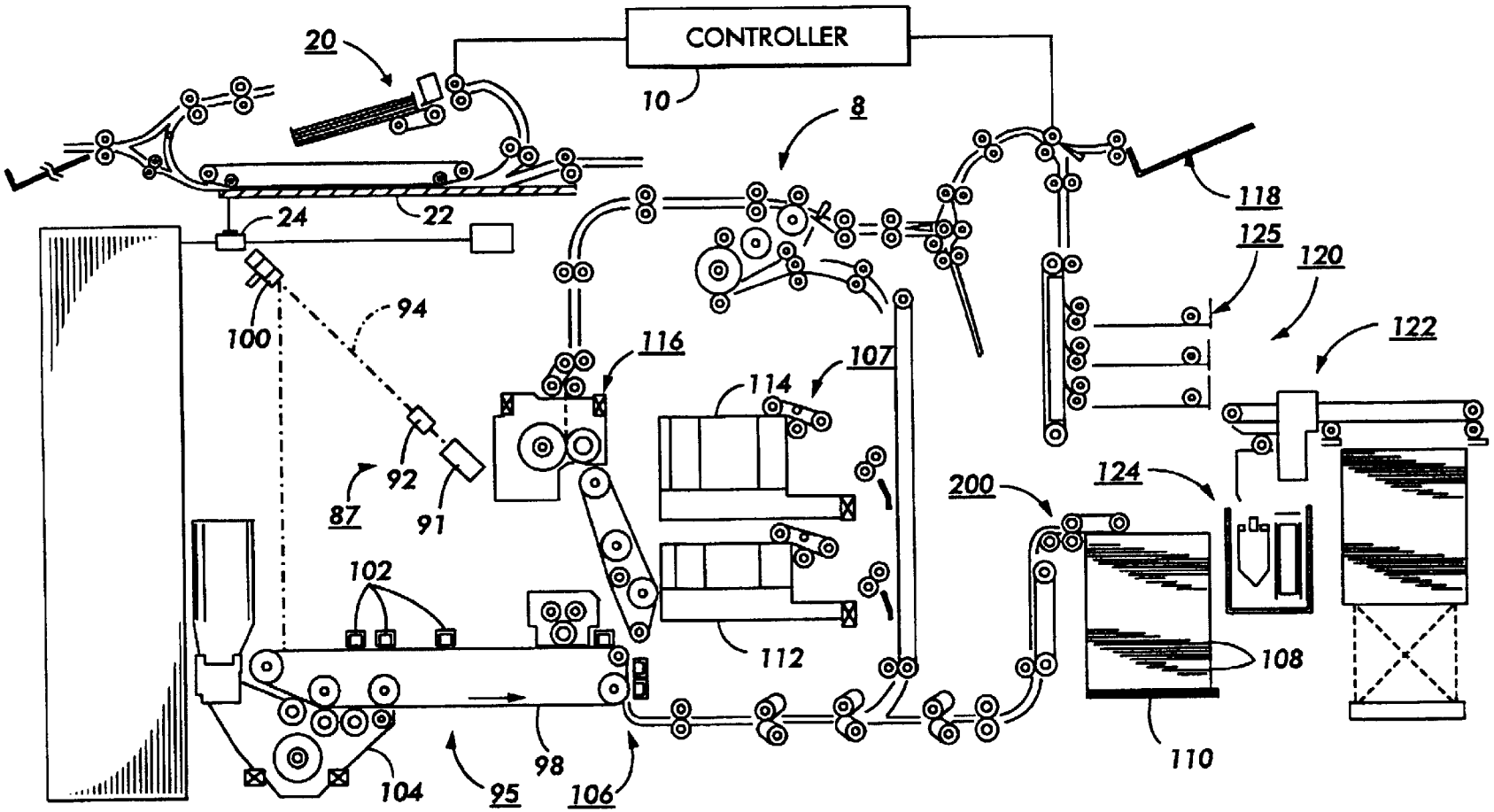
FIG. 3 is a schematic side view of a copier/printer that incorporates the improved sheet feeder of the present invention. While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Reference is now made to the drawings where the showings are for the purpose of illustrating a preferred embodiment of the invention and not for limiting same, the various processing stations employed in the printing machine illustrated in FIG. 3 will be briefly described.

Referring now to FIG. 3, printer section 8 comprises a laser type printer and for purposes of explanation is separated into an original document presentation system 20 that presents documents to platen 22, an electronic document imaging system 24, a Raster Output Scanner (ROS) section 87, Print Module Section 95, Paper Supply section 107, and Finisher 120. ROS 87 has a laser, the beam of which is split into two imaging beams 94. Each beam 94 is modulated in accordance with the content of an image signal input by acousto-optic modulator 92 to provide dual imaging beams 94. Beams 94 are scanned across a moving photoreceptor 98 of Print Module 95 by the mirrored facets of a rotating polygon 100 to expose two image lines on photoreceptor 98 with each scan and create the latent electrostatic images represented by the image signal input to modulator 92. Photoreceptor 98 is uniformly charged by corotrons 102 at a charging station preparatory to exposure by imaging beams 94. The latent electrostatic images are developed by developer 104 and transferred at a transfer station 106 to a print media 108 delivered by Paper Supply section 107. Media 108, as will appear, may compromise any of a variety of sheet sizes, types and colors. For transfer, the print media is brought forward by servo controlled rolls in timed registration with the developed image on photoreceptor 98 from either a main paper tray 110 or from auxiliary paper trays 112, or 114. The developed image transferred to the print media 108 is permanently fixed or fused by fuser 116 and the resulting prints discharged to either output tray 118, or to output collating trays in finisher 120. Finisher 120 includes a stitcher 122 for stitching (stapling) the prints together to form books, and a thermal binder 124 for adhesively binding the prints into books and a stacker 125.

The control of all machine functions, including all sheet feeding, is, conventionally, by the machine controller 10. Controller 10 is preferably a known programmable microprocessor, exemplified by the microprocessor disclosed in U.S. Pat. No. 4,166,558. The controller 10 conventionally controls all of the machine steps and functions described herein, and others, including the operation of the document feeder 20, all of the document and copy sheet deflectors or gates, the sheet feeder drives, the finisher, etc. The controller also conventionally provides for storage and comparison of the counts of the copy sheets, the number of documents recirculated in a document set, the desired number of copy sets and other selections and controls by the operator through the console or other panel of switches connected to the controller, etc. The controller is also programmed for time delays from correction control, etc. Conventional path sensors or switches may be utilized to help keep track of the position of the documents and the copy sheets and the moving components of the apparatus by connection to the controller. In addition, the controller variably regulates the various positions of the gates depending upon which mode of operation is selected.

Figure 1:
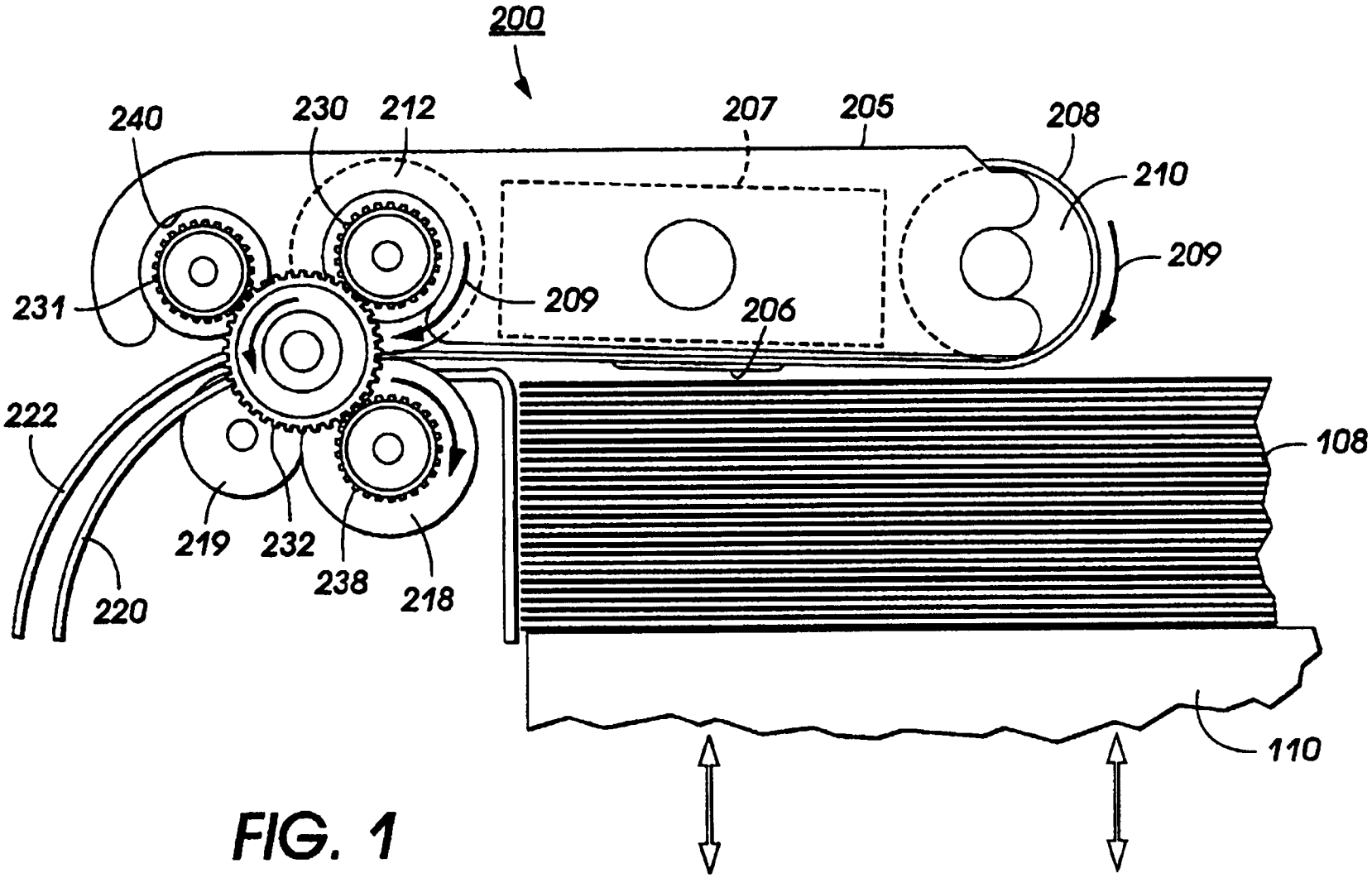
FIG. 1 is an enlarged, partial side view of the improved sheet feeder in accordance with the present invention.
Figure 2:
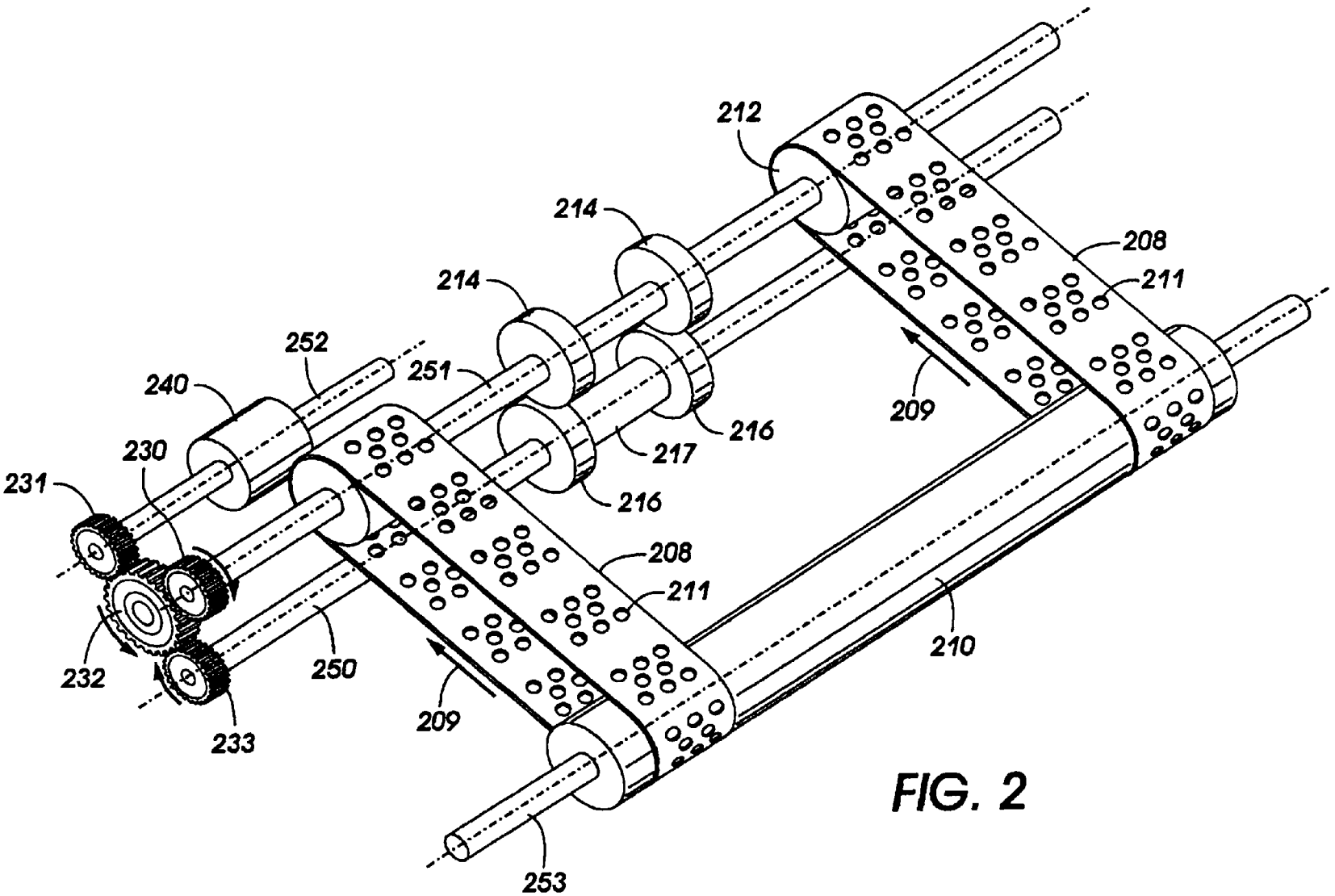
FIG. 2 is an enlarged, partial perspective view of the drive mechanism of the sheet feeder of FIG. 1.

Referring now to a particular aspect of the present invention, the copier/printer of FIG. 3 includes an improved copy sheet feeder 200 shown in FIGS. 1 and 2 that feeds copy sheets at high speeds individually from main paper tray 110. Copy sheet feeder 200 comprises a top vacuum corrugation device combined with a top active retard separation mechanism. A vacuum corrugation device includes a housing 205 with a vacuum plenum 207 positioned over the front end of copy sheets 108 supported in a tray 110. Belts 208 are entrained around drive rollers 212, idler roll 210, and vacuum plenum 207. Belts 208 could be made into a single belt, if desired. Perforations 211 are shown in FIG. 2 in belts 208 that allow a suitable vacuum source (not shown) to apply a vacuum through plenum 207 and belts 208 to acquire sheets 108 from a stack of sheets. Corrugation rail 206 is attached or molded into the underside and center of plenum 207 and causes sheets acquired by the vacuum plenum to bend during the corrugation so that if a second sheet is still sticking to the sheet having been acquired by the vacuum plenum, the corrugation will cause the second sheet to detack and fall back into the tray. A sheet captured on belts 208 is forwarded through baffles 220 and 222 and into a nip formed between a takeaway drive roll (not shown) and idler roll 219. In order to prevent multifeeding from tray 110, a retard mechanism is positioned prior to the nip formed between the takeaway and idler rolls that includes a retard roll 216 and drive rolls 214. Retard roll 216 has a built in conventional slip clutch 217 which provides the retarding forces to the copy sheets being fed. The slip clutch torque and normal force for the retard roll are sized such that the following will occur: 1) if only 1 sheet enters the retard nip, the roll to paper friction drive force is greater than the slip clutch retarding force. Therefore, the retard roll idles forward, allowing the sheet to be fed with no relative motion between the sheet and the retard nip; 2) if multiple sheets enter the retard nip, the paper to roll friction retarding force (which retards sheets 2-N) is sufficient to overcome the paper to paper friction within the slugs of sheets and sheets 2-N are driven back into the sheet stack.

As shown in FIG. 2, the retard mechanism 214, 216 and 217, vacuum belts 208 and a takeaway drive roll (not shown) and a mating idler roll 219 are rotated by a gear train that includes shaft mounted meshing gears 230, 231, 232 and 233. The gear train drives belts 208 in the direction of arrows 209. A shaft 253 supports idler roll 210 for rotation while shaft 251 supports belt drive rolls 212 and drive rolls 214 that mate with retard retard roll 216. Gear 233 connected to shaft 250 rotates retard roll 216 and slip clutch 217. Gear 231 connected to shaft 252 rotates a takeaway roll (not shown) and clutch assembly 240. A drive gear 232 provides rotation to gears 230, 231 and 233.

Cut sheet feeder 200 that includes a combination of top vacuum corrugation feeder mechanism followed by a top active retard roll separation mechanism has several advantages over feeders that use an air knife in a top vacuum corrugation feeder including greater system latitude in handling paper variations due to the mechanical separation. Also, the stack height setting can be raised closer to the feedhead, reducing the open port flow requirements for the vacuum system. This allows for smaller, quieter, less expensive blower assemblies and feedheads when multiple feeders are involved. With less expensive blowers, separate blowers can be employed for each feedhead. This eliminates complexities involved with tray switching schemes for tabs, inserts, covers, etc.

It should be now understood that an improved top vacuum corrugation feeder has been disclosed that includes a top active retard feeder in place of the conventional air knife used in such feeders in order to improve reliability, decrease cost, decrease noise and decrease power requirements of the feeder.

The invention has been described with reference to the preferred embodiment. Obviously, modifications and alterations will occur to others upon a reading and understanding of the specification. It is intended to include all such modifications and alterations insofar as they come within the spirit and scope of the appended claims or the equivalent thereof.

What is claimed is:

1. A top sheet feeding apparatus for feeding both stiff and flimsy copy sheets, comprising:

a sheet supporting tray adapted to support a stack of copy sheets;

a sheet feedhead including a vacuum plenum chamber adapted to extend over the front of the stack of copy sheets when the stack of copy sheets is placed in said support tray, and a plurality of perforated belts mounted on drive and idler rolls and entrained around said vacuum plenum chamber for individually transporting copy sheets in a downstream direction attached to said perforated belts by vacuum from said vacuum plenum; and a top active retard roll separation mechanism positioned adjacent to said downstream end of said plurality of perforated belts with a retard roll positioned between said plurality of perforated belts and an opposing drive roll for driving said copy sheets in a downstream direction away from said stack of copy sheets, so as to separate double sheet feeds transported thereinto by said feedhead.

2. The top sheet feeding apparatus of claim 1, wherein said top active retard roll separation mechanism includes a first shaft and two retard rolls mounted on said first shaft and separated by a slip clutch mechanism, and a second shaft including two drive rolls mounted thereon that mate with said two retard rolls.

3. The top sheet feeding apparatus of claim 2, wherein said vacuum plenum chamber has a sheet corrugating member extending centrally of its bottom surface in said downstream direction.

4. The top sheet feeding apparatus of claim 1, wherein said vacuum plenum chamber has a sheet corrugating member centrally of its bottom surface.

* * * * *